US009897056B1

(12) United States Patent
Kimball et al.

(10) Patent No.: US 9,897,056 B1
(45) Date of Patent: Feb. 20, 2018

(54) PROTECTIVE COVER ASSEMBLY FOR A FUEL PUMP

(71) Applicant: GM GLOBAL TECHNOLOGY OPERATIONS LLC, Detroit, MI (US)

(72) Inventors: Matthew D Kimball, Clarkston, MI (US); Marc L Friedrich, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/358,534

(22) Filed: Nov. 22, 2016

(51) Int. Cl.
*F02M 17/30* (2006.01)
*F02M 59/44* (2006.01)

(52) U.S. Cl.
CPC ..... *F02M 59/44* (2013.01)

(58) Field of Classification Search
CPC ..... F02M 59/44; F02M 35/10216; F02M 37/0082; F02M 59/447; F02M 63/00; F02M 2700/13; F02M 26/74; F02M 35/10236
USPC ..... 123/198 D
See application file for complete search history.

(56) References Cited

U.S. PATENT DOCUMENTS 1,908,092 A 5/1933 Whitted
5,383,436 A 1/1995 Fehlmann
5,794,594 A 8/1998 Fehlmann
7,401,594 B2 7/2008 Usui et al.
7,574,991 B2 8/2009 Kumagai et al.
7,784,580 B2 * 8/2010 Takahata ..... F02M 59/102 180/274
8,511,282 B2 8/2013 Jang
8,646,436 B2 * 2/2014 Wakabayashi ..... F02F 7/006 123/509
9,518,546 B2 * 12/2016 Hopley ..... F02M 59/485
2003/0084884 A1 5/2003 Sawert et al.
2004/0247464 A1 * 12/2004 Suzuki ..... F04B 23/103 417/410.3
2008/0251149 A1 10/2008 Boutros et al.
2008/0289713 A1 11/2008 Munakata et al.
2015/0337784 A1 * 11/2015 Ishikawa ..... F02M 37/06 123/198 E

* cited by examiner

*Primary Examiner* — Hung Q Nguyen
*Assistant Examiner* — Anthony Taylor, Jr.

(57) ABSTRACT

A protective cover assembly for a fuel pump in a motor vehicle includes a hooded cover having a first face and a second face in addition to distal and proximate stud bolts, and a base fastener. The hooded cover defines a plurality of apertures operatively configured to receive a corresponding fastener. The distal stud bolt may be operatively configured to affix a distal end of the hooded cover to a cam carrier. The proximate stud bolt may be operatively configured to affix a middle region of the hooded cover to the cam carrier while the base fastener may be operatively configured to affix a lower portion of the hooded cover to the cam carrier. The proximate stud bolt includes an outer diameter feature which is operatively configured to engage with a plunger region of the pump assembly when the proximate cover assembly is subjected to a load.

20 Claims, 6 Drawing Sheets

PROTECTIVE COVER ASSEMBLY FOR A FUEL PUMP

TECHNICAL FIELD

The invention relates generally to automotive fuel supply systems, and more particularly to a protective fuel pump cover used in automotive fuel supply systems.

BACKGROUND

Many automotive fuel supply systems include a fuel tank for storing fuel. In one arrangement, a fuel delivery module including, among other things, a housing, a fuel pump, and a fuel filter may be provided for an automotive vehicle. In one arrangement, the fuel pump may be arranged in-line with one or more fuel delivery lines. In operation, fuel typically travels through the fuel filter, into the fuel pump, and to an internal combustion engine.

A traditional fuel injection pump may include a membrane or movable wall which divides the storage chamber from the drive mechanism chamber. The membrane/diaphragm can reduce the sudden loading of the storage chamber by the fuel, which has been previously brought to injection pressure and is sent into the storage chamber at the end of the feed stroke that effects the injection, by virtue of the fact that the diaphragm yields to the pressure surge against the drive mechanism chamber, which is under a lower pressure, and offsets the outflow quantity. At the same time, during the intake stroke of the pump piston, the filling process of the pump work chamber is positively supported by the simultaneous volume change in the intake chamber and drive mechanism chamber. The pressure difference in the storage chamber and the drive mechanism chamber, which acts on this pump piston during its intake stroke, powers the pump piston in the intake stroke direction and obviates the need for a separate spring for returning the pump piston from its top dead center position to its bottom dead center position after the pressure or filling stroke.

Accordingly, with reference to FIG. 1, many fuel pumps 108 implement a dampener 118 in order to dampen pressure oscillations—due to reciprocating movement of the plunger 122 in the pump 108. As is known, the plunger 122 in a fuel pump 108 engages in three processes resulting in the reciprocating movement: (1) the plunger 122 moves to take in fuel from the fuel intake joint to the pressure chamber 126; (2) the plunger 122 moves to deliver fuel from the pressure chamber 126 to the common rail; and (3) the plunger 122 moves to return fuel from the pressure chamber 126 to the fuel intake passage. The dampener 118 may be at least partially defined by at least one diaphragm 120 that is acted upon by lubrication pressure. Therefore, should a load 130 be applied to the dampener 118, it is possible to risk the structural integrity of this liquid chamber. It is understood that the region of the pump 108 containing the plunger 122 is generally more robust relative to the dampener region 134 given that the plunger 122 is generally slidable within a cylindrical structure 132 in the fuel pump 108, and therefore, the plunger region 136 is less susceptible to rupture risk in the event that a load 130 is applied to the plunger region 136.

Because of the great pressure difference between the pressure in the pressure chamber 126 and the pressure in the drive mechanism chamber, the diaphragms 120 are optimally designed for pressure fluctuations. As shown in FIG. 1, these components, including the fuel pump plunger 122, are traditionally protected by pump body 110 shown as element 110 in FIG. 1. However, when a load 130 is applied directly to pump body 110, the pump body 110 may transfer the load 130 directly to the pressure chamber 126 having at least one diaphragm 120, filled with liquid given that the pump body 110 closely encases the pressure chamber 126 (shown in FIG. 1).

Accordingly, it would be desirable in the industry to produce a fuel pump cover which is designed to deflect loads imposed on the region of a fuel pump having a pressure chamber.

SUMMARY

Accordingly, the present disclosure provides a protective cover assembly for a fuel pump in a motor vehicle. The protective cover assembly includes a hooded cover having a first face and a second face in addition to distal and proximate stud bolts, and a base fastener. The second face of the hooded cover may be integral to the first face. The hooded cover may define a plurality of apertures operatively configured to receive a corresponding fastener. The distal stud bolt may be operatively configured to affix a distal end of the hooded cover to a cam carrier. The proximate stud bolt may be operatively configured to affix a middle region of the hooded cover to the cam carrier while the base fastener may be operatively configured to affix a lower portion of the hooded cover to the cam carrier.

It is understood that, in another embodiment, a protective cover assembly under the present disclosure may also include a hooded cover having a substantially horizontal face and a substantially diagonal face in addition to distal and proximate stud bolts, and a base fastener. The substantially diagonal face of the hooded cover may be integral to the first face. The hooded cover may define a plurality of apertures operatively configured to receive a corresponding fastener. The distal stud bolt may be operatively configured to affix a distal end of the substantially horizontal face to a cam carrier. The proximate stud bolt may be operatively configured to affix a middle region of the hooded cover to the cam carrier while the base fastener may be operatively configured to affix a lower portion of the substantially diagonal face to the cam carrier.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description of preferred embodiments, and best mode, appended claims, and accompanying drawings in which:

Like reference numerals refer to like parts throughout the description of several views of the drawings.

DETAILED DESCRIPTION

Figure 1:
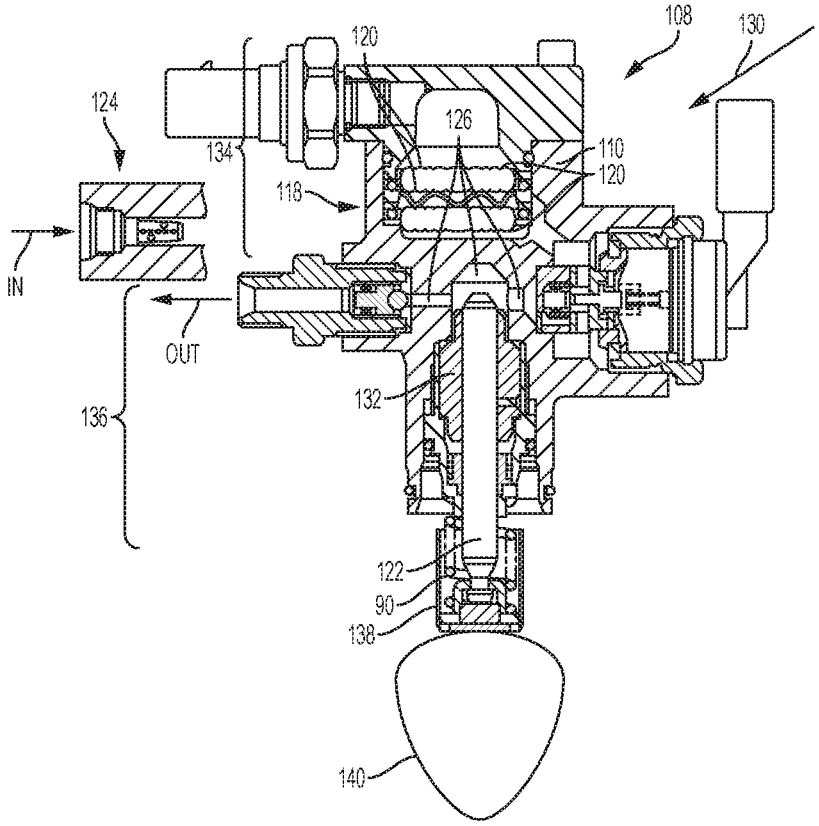
FIG. 1 is a cross sectional view of a fuel pump engaged with a cam.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

Figure 2:
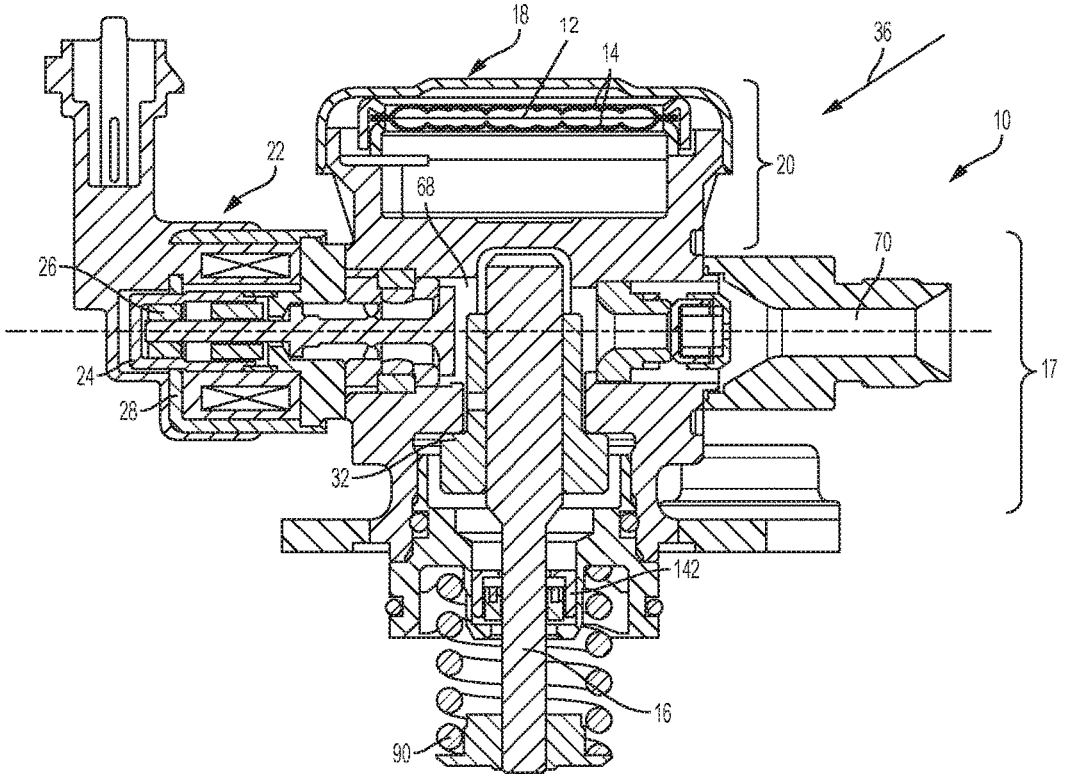
FIG. 2 is a cross sectional view of another fuel pump having a dampener with a pressure chamber and diaphragm(s) together with a plunger in a fuel pump body.

Referring now to FIG. 2, a cross sectional view of an example fuel pump 10 having a dampener with a pressure chamber and diaphragm(s) 14 together with a plunger 16 in a fuel pump body is shown. The example fuel pump 10 includes a dampener 18 having two diaphragms 14 joined together in a fluid filled pressure chamber 12 in order to dampen pressure oscillations—due to reciprocating movement of the plunger 16 in the pump 10. As is known, the plunger 16 in a fuel pump 10 engages in three processes resulting in the reciprocating movement: (1) the plunger 16 moves to take in fuel from the fuel valve 28 to the pressure chamber 68; (2) the plunger 16 moves to deliver fuel from the pressure chamber 68 to the common rail 70; and (3) the plunger 16 moves to return fuel from the pressure chamber 68 to the fuel valve 28. The pressure chamber 68 as well as the dampener 18 as shown are acted upon by pressure pulsations and therefore may be sensitive to external loads 36 applied to pressure chamber 68 and the dampener region 20. It is understood that dampener region 20 may include the dampener 18 in addition to pressure chamber 68.

A lifter 138 (shown in FIG. 1) may be provided at the end of plunger 16 which is then contacted to a cam 140 (shown in FIG. 1) by a spring 90. The plunger 16 may be slidably held in cylinder 32. The plunger 16 may therefore be caused to reciprocate by a cam rotated by an engine cam shaft or the like, which thereby changes the volume of the pressure chamber 68. The cylinder 32 may be sealed with a plunger seal 142 in order to prevent blowby of gasoline from leaking out toward the camshaft 140 (shown in FIG. 1). The fuel valve 28 opens and closes in synchronization with the reciprocating motion of the plunger 16.

Given the fluid pressure and diaphragm(s) 14 used in the dampener portion 20 of the fuel pump 10, the dampener 18 and pressure chamber 68 may be particularly vulnerable to external loads 36 thereby requiring protection. The present disclosure, therefore, provides a protective cover assembly 30 which deflects loads 36 applied toward the dampener region 20 and re-routes such loads 36 to prevent potential leaks in the dampener region 20 of the fuel pump 10. It is understood that the plunger 16 disposed in the cylinder 32 is generally more robust and less vulnerable to external loads 36 due to the substantial structure provided in the plunger 16/cylinder arrangement.

With reference to FIG. 2, a cross sectional view of another example fuel pump 10 is shown without the fuel pump cover assembly 30 of the present disclosure where the dampener portion 20 of the fuel pump 10 (with a pressure chamber) is disposed in the upper region of the fuel pump 10 and the plunger 16 (similar to that shown in FIG. 1) in the fuel pump body is disposed in the lower region of the fuel pump 10. As shown, fuel intake port 40 attaches to the fuel pump 10, and at least two stud bolts 42, 44 of the cover assembly may be provided diagonally from one another to mount the fuel pump 10 in the vehicle. The proximate stud bolt 42 and the distal stud bolt 44 (shown in FIG. 4) may be used to mount the fuel pump to the cam carrier (shown in FIG. 3). It is also understood that the at least two stud bolts 42, 44 (shown in FIG. 4) have sufficient vertical length such that the stud bolts 42, 44 (shown in FIGS. 4 and 6) support the hooded cover (shown in FIG. 3) against any loads 36 (shown in FIG. 6) which may be directed to the dampener portion 20 of the fuel pump 10—as explained in the present disclosure.

Figure 3:
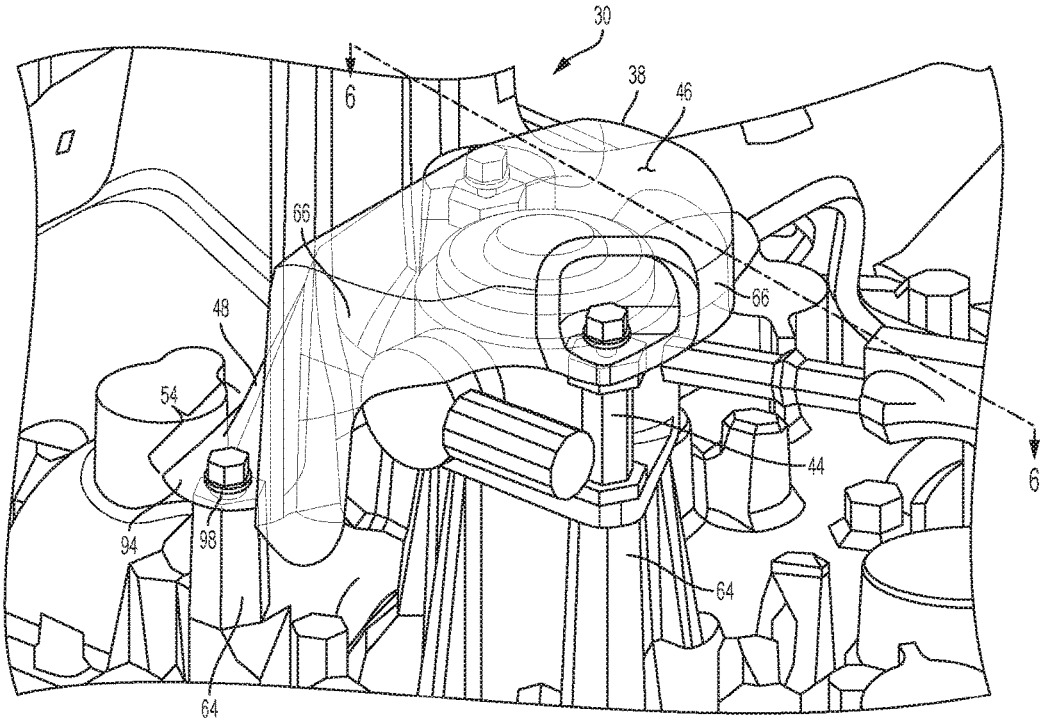
FIG. 3 is a perspective view of an example, non-limiting fuel pump cover according to various embodiments of the present disclosure.

Referring now to FIG. 3, a perspective view of an example, non-limiting fuel pump cover assembly 30 according to various embodiments of the present disclosure is shown in phantom relative to the fuel pump 10. As shown the fuel pump cover assembly 30 includes a first face 46 (substantially horizontal face) integral with a second face 48 (substantially diagonal face) disposed at an angle relative to the first face 46. As shown in FIGS. 3-6, the second face 48 (substantially diagonal face) may be integral to one or more mounting flanges 94 to secure the hooded cover 38 to the cam carrier 64 at a lower end 54 of the fuel pump cover assembly 30. Moreover, it is understood that the second face 48 (substantially diagonal face) may be positioned at an angle in the range of approximately 90 degrees to 180 degrees relative to the first face 46 (substantially horizontal face).

Figure 4:
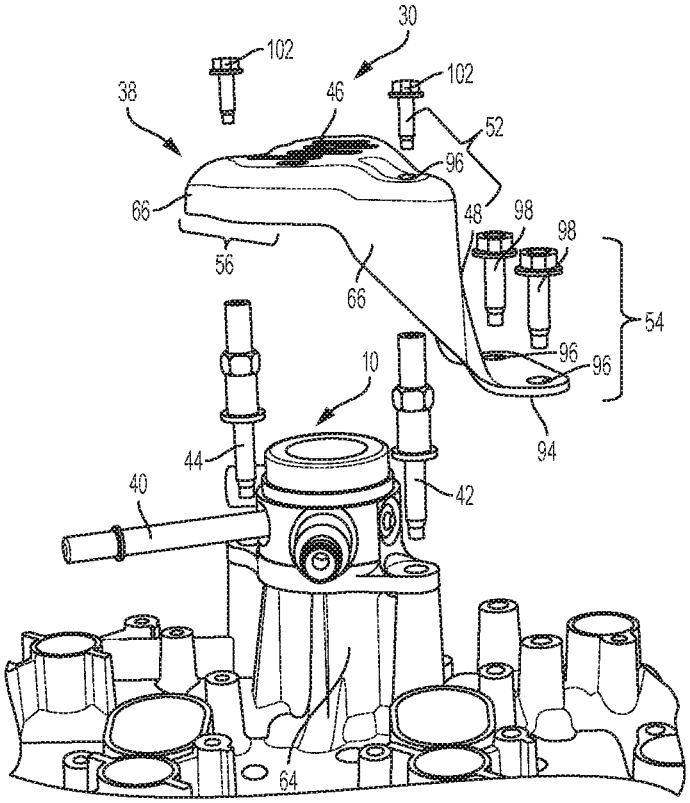
FIG. 4 is an expanded view of a protective cover assembly according to various embodiments of the present disclosure.

Referring now to FIG. 4, expanded views of two different embodiments of the cover assembly 30 are shown. In FIG. 4, stud bolts 42, 44 are used to mount fuel pump 10 cam carrier and also used to secure hooded cover to fuel pump via top fasteners 102 which may engage with stud bolts 42, 44. Moreover, fasteners 98 may be used to secure lower portion of hooded cover at mounting flange 94 to cam carrier as shown.

Figure 6:
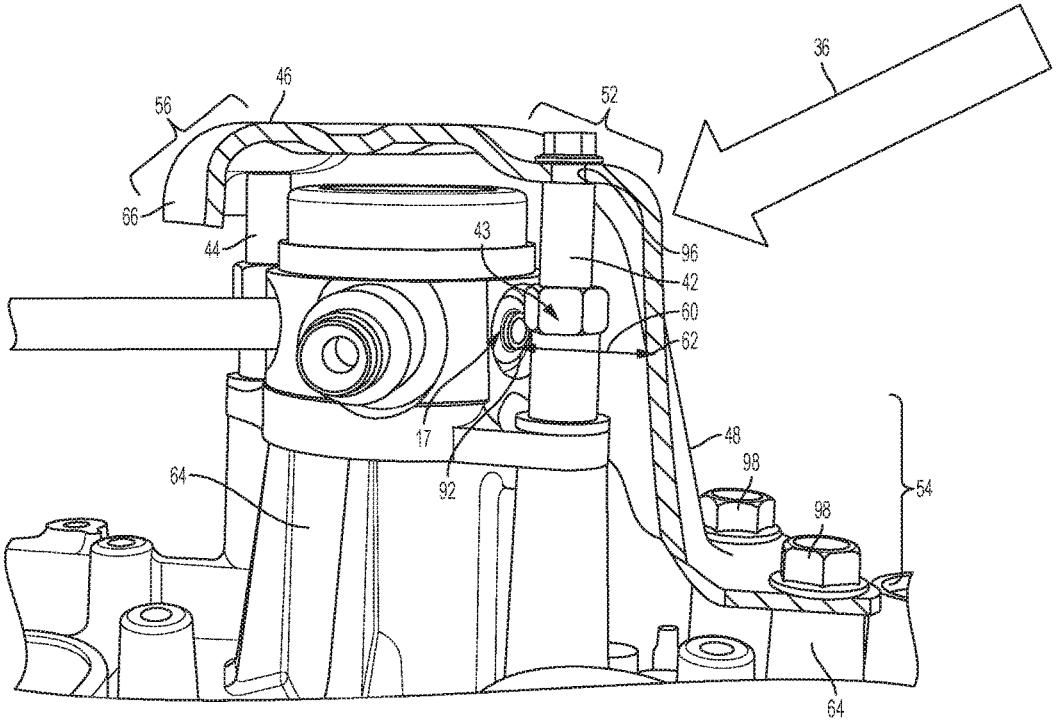
FIG. 6 is a cross sectional view of the example, non-limiting fuel pump cover and fuel pump in FIG. 3 along line 6-6 when no load is applied to the cover assembly.

As shown in FIG. 6, the first face 46 may define one or more apertures 96 to secure the stud bolts 42, 44 which are operatively configured to support the hooded cover 38 against any loads 36 which may be directed to the dampener portion 20. As shown in FIG. 2, a distal stud bolt 44 maintains the position of the distal end 50 of the first face 46 in order to maintain the first face 46 of the fuel pump cover assembly 30 completely over the dampener 18. With reference now to FIG. 6, a cross sectional view of the example, non-limiting fuel pump cover assembly 30 and fuel pump 10 in FIG. 3 along line 6-6 is shown. This cross section illustrates the proximate stud bolt 42 securing the fuel pump cover assembly 30 in a middle region 52 of the fuel pump cover assembly 30. It is understood that the middle region 52 of the fuel pump cover assembly 30 is disposed between the lower portion 54 of the fuel pump cover assembly 30 and the distal region 56 of the fuel pump cover assembly 36.

Figure 5:
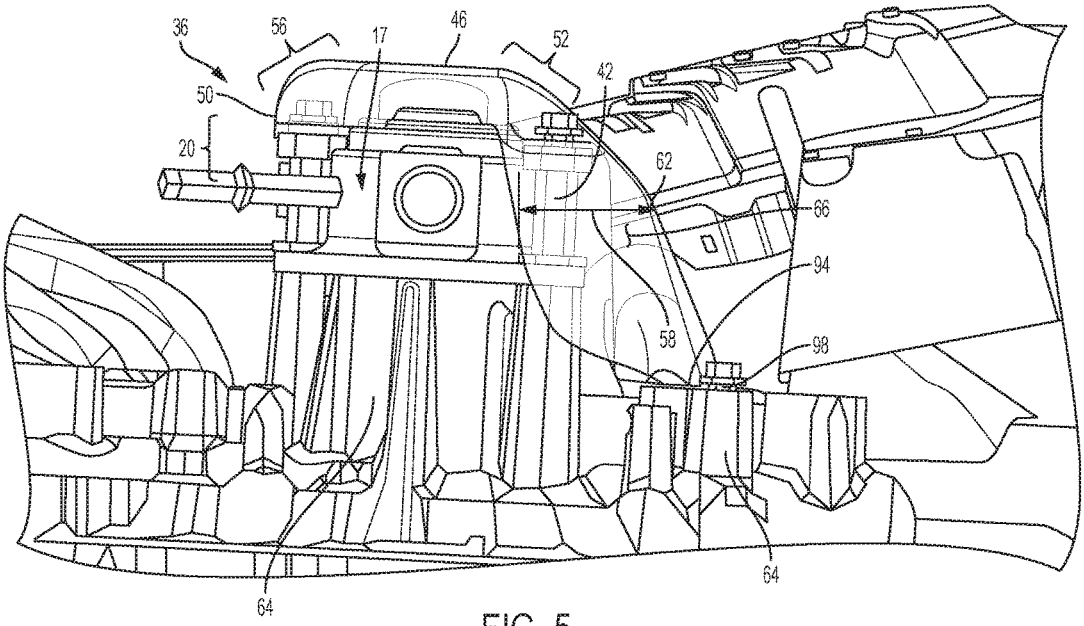
FIG. 5 is a side view of a protective cover assembly according to various embodiments of the present disclosure when no load is applied to the cover assembly.

In the example shown in FIG. 5, the proximate stud bolt 42 is secured in an aperture 96 defined the middle region 52. Accordingly, the proximate stud bolt 42 maintains the position of the middle region 52 of the fuel pump cover assembly 30 so as to protect the dampener region 20 of the fuel pump 10 in the event a load 36 (shown in FIG. 7) is applied toward the dampener region 20. In FIG. 5, when load 36 is applied toward the dampener region 20 of the fuel pump 10, the second face 48 of the fuel pump cover assembly 30 may slightly deflect and absorb energy from the load 36 while the proximate stud bolt 42 prevents the fuel pump cover assembly 30 from deflecting and interfering with the dampener region 20 of the fuel pump 10. In an overload condition, an outer diameter feature 43 (shown as a hex feature) on stud bolt 42 will contact the plunger region 17 (lower region) of the fuel pump 10 as the stud bolt 42 absorbs energy from a load 36. As indicated earlier, the plunger region 17 of the fuel pump is generally consider more robust in light of the plunger cylinder arrangement. As shown, the fasteners 98 affixed to the mounting flanges 94 also prevent the excessive displacement of the fuel pump cover assembly 30 (and potential interference with the dampener region) in the event that load 36 is applied toward the dampener region 20.

With reference to FIG. 5, a side view of an example, non-limiting fuel pump cover assembly 30 is shown when no load is applied to the fuel pump cover assembly 30. As shown in FIG. 5, a first predetermined distance 58 is provided between the midpoint 62 of the second face 48 and the vertical side 92 of the fuel pump 10 when no load is applied to toward the fuel pump 10. However, when a load 36 is applied toward the dampener portion 20 of the fuel pump 10, a second/shorter predetermined distance 60 is provided between the midpoint 62 of the second face 48 and the vertical side 92 of the fuel pump 10 due to the deflection of the fuel pump cover assembly 30 toward the fuel pump 10, absorption of energy and transfer of energy from the applied load 36 of FIG. 5.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A protective cover assembly for a fuel pump comprising:

a hooded cover having a first face and a second face integral to the first face, the hooded cover defining a plurality of apertures, each of said apertures being operatively configured to receive a corresponding fastener;

a distal stud bolt operatively configured to affix a distal end of the hooded cover to a first part of a cam carrier;

a proximate stud bolt operatively configured to affix a middle region of the hooded cover to a second part of the cam carrier; and a base fastener operatively configured to affix a lower portion of the hooded cover to a third part of the cam carrier.

2. The protective cover assembly for a fuel pump of claim 1 wherein the second face is positioned at an angle in a range of approximately 90 degrees to 180 degrees relative to the first face.

3. The protective cover assembly for a fuel pump of claim 1 wherein the plurality of apertures include a distal aperture defined by the first face proximate to the distal end of the hooded cover, the distal aperture being operatively configured to receive the distal stud bolt.

4. The protective cover assembly for a fuel pump of claim 1 wherein a midpoint in the second face defines a first predetermined distance from the fuel pump when no load is applied to the hooded cover, and the midpoint in the second face defines a second, shorter predetermined distance from the fuel pump when a load is applied to the hooded cover.

5. The protective cover assembly for a fuel pump of claim 1 wherein a fixed distance is maintained between a dampener region of the fuel pump and the hooded cover.

6. The protective cover assembly for a fuel pump of claim 1 further comprising a vertical surface integral to both the first and second faces.

7. The protective cover assembly for a fuel pump of claim 1 wherein the lower portion of the hooded cover defines a mounting flange integral with the second face, the mounting flange further defining a lower aperture operatively configured to receive the base fastener to secure the hooded cover to the third part of the cam carrier.

8. The protective cover assembly for a fuel pump of claim 3 wherein the plurality of apertures include a proximate aperture defined by the first face in the middle region of the hooded cover, the proximate aperture being operatively configured to receive the proximate stud bolt.

9. The protective cover assembly for a fuel pump of claim 3 wherein the proximate stud bolt is operatively configured to absorb energy upon impact, the proximate stud bolt includes an outer diameter feature operatively configured to engage with a plunger region of the fuel pump when the proximate stud bolt absorbs energy.

10. The protective cover assembly for a fuel pump of claim 4 wherein the first and second predetermined distances are defined between a fuel pump cylinder and the midpoint in the second face.

11. A protective cover assembly for a fuel pump comprising:

a hooded cover having a substantially horizontal face and a substantially diagonal face integral to the substantially horizontal face, the hooded cover defining a plurality of apertures, each of said apertures being operatively configured to receive a corresponding fastener;

a distal stud bolt operatively configured to affix a distal end of the hooded cover to a first part of a cam carrier;

a proximate stud bolt operatively configured to affix a middle region of the hooded cover to a second part of the cam carrier; and a base fastener operatively configured to affix a lower portion of the hooded cover to a third part of the cam carrier.

12. The protective cover assembly for a fuel pump of claim 11 wherein the substantially diagonal face is positioned at an angle in a range of approximately 90 degrees to 180 degrees relative to the substantially horizontal face.

13. The protective cover assembly for a fuel pump of claim 12 wherein the plurality of apertures include a distal aperture defined by the substantially horizontal face proximate to the distal end of the hooded cover, the distal aperture being operatively configured to receive the distal stud bolt.

14. The protective cover assembly for a fuel pump of claim 12 wherein a midpoint in the substantially diagonal face defines a first predetermined distance from the fuel pump when no load is applied to the hooded cover, and the midpoint in the substantially diagonal face defines a second, shorter predetermined distance from the fuel pump when a load is applied to the hooded cover.

15. The protective cover assembly for a fuel pump of claim 12 wherein a fixed distance is maintained between a dampener region of the fuel pump and the hooded cover.

16. The protective cover assembly for a fuel pump of claim 12 further comprising a vertical surface integral to both the substantially horizontal and substantially diagonal faces.

17. The protective cover assembly for a fuel pump of claim 12 wherein the lower portion of the hooded cover defines a mounting flange integral to the substantially diagonal face, the mounting flange further defining a lower aperture operatively configured to receive the base fastener to secure the hooded cover to the third part of the cam carrier.

18. The protective cover assembly for a fuel pump of claim 13 wherein the plurality of apertures include a proximate aperture defined by the substantially horizontal face in the middle region of the hooded cover, the proximate aperture being operatively configured to receive the proximate stud bolt.

19. The protective cover assembly for a fuel pump of claim 13 wherein the distal stud bolt defines an outer diameter feature operatively configured to engage with a plunger region of the fuel pump when the distal stud bolt absorbs energy from a load.

20. The protective cover assembly for a fuel pump of claim 14 wherein the first and second predetermined distances are defined between a fuel pump cylinder and the midpoint in the substantially diagonal face.

* * * * *